US006672583B2

(12) United States Patent
Wei

(10) Patent No.: US 6,672,583 B2
(45) Date of Patent: Jan. 6, 2004

(54) DOUBLE-SIDE AUTOMATIC FEEDING APPARATUS

(75) Inventor: Frank Wei, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 10/160,262

(22) Filed: Jun. 4, 2002

(65) Prior Publication Data

US 2003/0222393 A1 Dec. 4, 2003

(51) Int. Cl.[7] ..... B65H 29/00
(52) U.S. Cl. ..... 271/186; 399/364
(58) Field of Search ..... 271/186, 65; 399/374, 399/364, 306

(56) References Cited

U.S. PATENT DOCUMENTS 4,986,529 A * 1/1991 Agarwal et al. ..... 271/291
5,855,367 A * 1/1999 Inoue et al. ..... 271/186
6,447,182 B2 * 9/2002 Brewington et al. ..... 400/188
6,478,490 B2 * 11/2002 Kelley et al. ..... 400/624
6,522,860 B2 * 2/2003 Nose et al. ..... 399/374

* cited by examiner

*Primary Examiner*—Donald P. Walsh
*Assistant Examiner*—Kaitlin Joerger
(74) *Attorney, Agent, or Firm*—Rosenberg, Klein & Lee

(57) ABSTRACT

A double-side automatic feeding apparatus comprises a paper feeder, a paper outlet opposite to the paper feeder, a scanning region having a document traveling path bridging the paper feeder and the paper outlet, a plurality of rollers being arranged in the scanning region to convey a document to be scanned from the paper feeder to the paper outlet, and a paper flipping unit arranged in the document traveling path. The paper flipping unit can be selectively switched position thereof and used to flip the document during the document traveling path. By the invention, the document can be scanned on both sides thereof without cumbersome reverse movement. The document can be automatically aligned by the weight per se and the operations of paper placement and removal can be simplified.

9 Claims, 7 Drawing Sheets

DOUBLE-SIDE AUTOMATIC FEEDING APPARATUS

FIELD OF THE INVENTION

The present invention relates to a double-side automatic feeding apparatus for document, especially to a double-side automatic feeding apparatus, wherein the document can be scanned on both sides thereof without cumbersome reverse movement.

BACKGROUND OF THE INVENTION

The scanners become popular peripherals for computer users as multimedia and web page design are gradually prevailing. The scanner generally senses a reflected light from a document of interest and converts the sensed light signal to a digital image signal for representing the document. The digital image signal can be processed with optical character recognition software to convert the digital image signal into textual file if the original document contains textual information.

To scan double-sided document, scanner for double-sided image has been developed. FIG. 1 shows a prior art scanner for double-sided image, which comprises a paper feeder 10*a*, a paper outlet 11*a* at same side as the paper feeder 10*a*, a scanning region 12*a* having a document traveling path 13*a* bridging the paper feeder 10*a* and the paper outlet 11*a*, a transparent window 14*a* and a direction-controlling wheel 15*a* opposite to the transparent window 14*a*, a rotary means 16*a* having an entrance path and an exit path connected to scanning region 12*a*. The entrance path is used to guide a document with one scanned side from the scanning region 12*a*, the exit path flipping the document and sending the flipped document to the scanning region 12*a* such that an unscanned side of the document can be processed in the scanning region 12*a*. A sensor 17*a* is placed at the exit of the rotary means 16*a* and sends a detection signal to the direction-controlling wheel 15*a* when sensing the appearance of the document and the direction-controlling wheel 15*a* will be commanded to rotate at opposite direction. An image sensor 18*a* is arranged at an outer side of the transparent window 14*a*. When the document is fed through the paper feeder 10*a* and passes to the transparent window 14*a*, the image sensor 18*a* senses an image at a first side of the document. When the document is flipped by the rotary means 16*a* and then again passes to the transparent window 14*a*, the image sensor 18*a* senses an image at a second side of the document.

However, in above-mentioned double-sided image scanner, the paper outlet 11*a* and the paper feeder 10*a* are located at the same side of the image scanner. The document should be returned to the paper outlet 11*a* after a long trip with flip operation. Therefore, the propagation distance of the document is long and the scanning time is increased.

Moreover, the paper outlet 11*a* and the paper feeder 10*a* are located at the same side of the image scanner and in two-decker arrangement along inclined or horizontal direction. The paper feeder 10*a* at the upper decker should be removed to fetch the scanned document.

SUMMARY OF THE INVENTION

It is an object of the present invention to provide a double-side automatic feeding apparatus, wherein the document can be scanned on both sides thereof without cumbersome reverse movement.

It is another object of the present invention to provide a double-side automatic feeding apparatus, wherein the document can be automatically aligned by the weight per se and the operations of paper placement and removal can be simplified.

To achieve above object, the present invention provides a double-side automatic feeding apparatus comprising a paper feeder, a paper outlet opposite to the paper feeder, a scanning region having a document traveling path bridging the paper feeder and the paper outlet, a plurality of rollers being arranged in the scanning region to convey a document to be scanned from the paper feeder to the paper outlet, and a paper flipping unit arranged in the document traveling path. The paper flipping unit can be selectively switched position thereof and used to flip the document during the document traveling path.

The various objects and advantages of the present invention will be more readily understood from the following detailed description when read in conjunction with the appended drawing, in which:

DETAILED DESCRIPTION OF THE INVENTION

Figure 1:
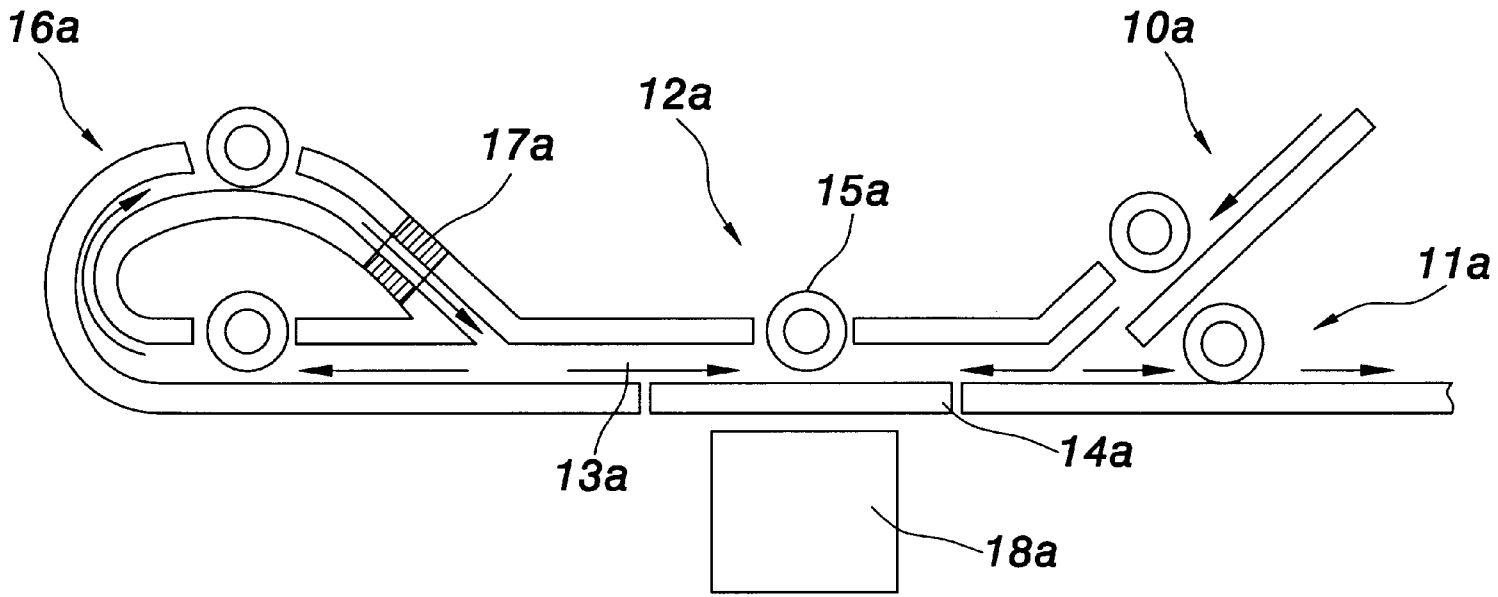
FIG. 1 PRIOR ART
FIG. 1 shows a sectional view of prior art double-side scanner.
Figure 2:
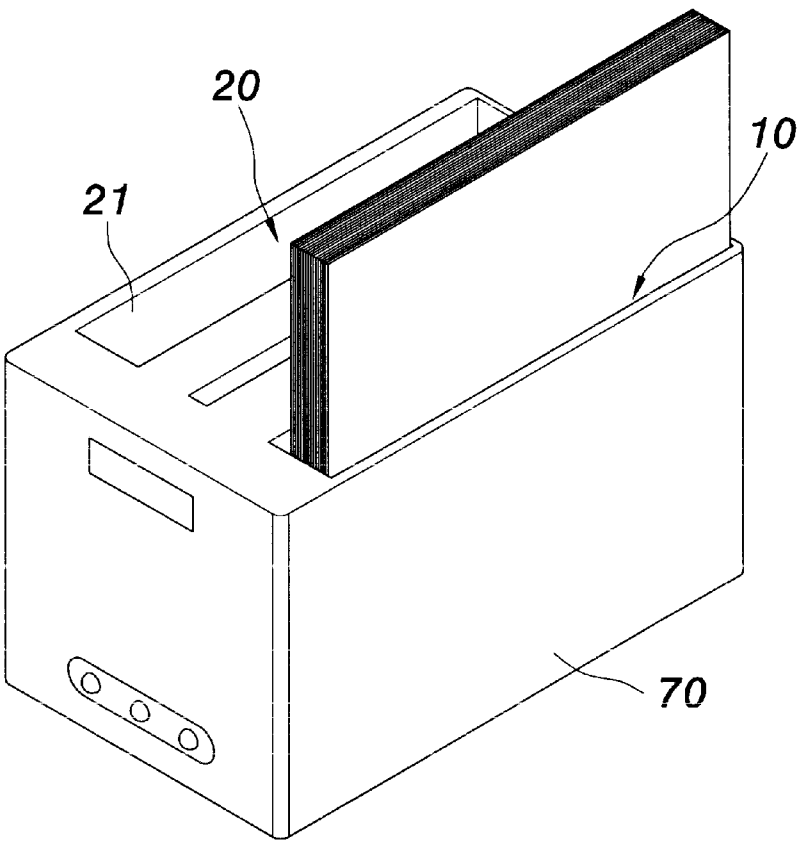
FIG. 2 shows a perspective view of the first preferred embodiment of the present invention.
Figure 3:
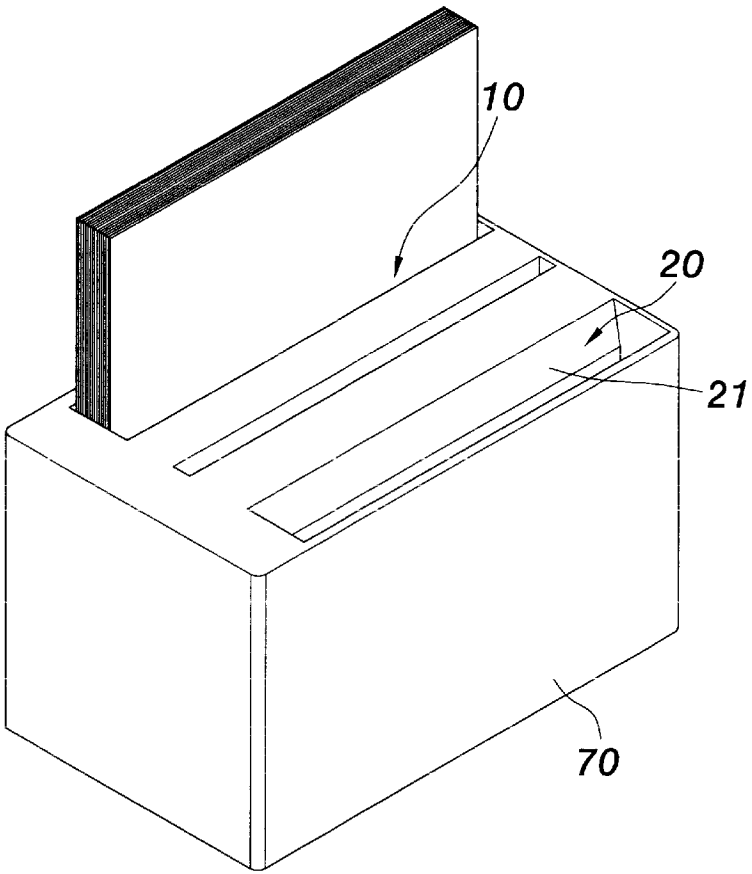
FIG. 3 shows another perspective view of the first preferred embodiment of the present invention.
Figure 4:
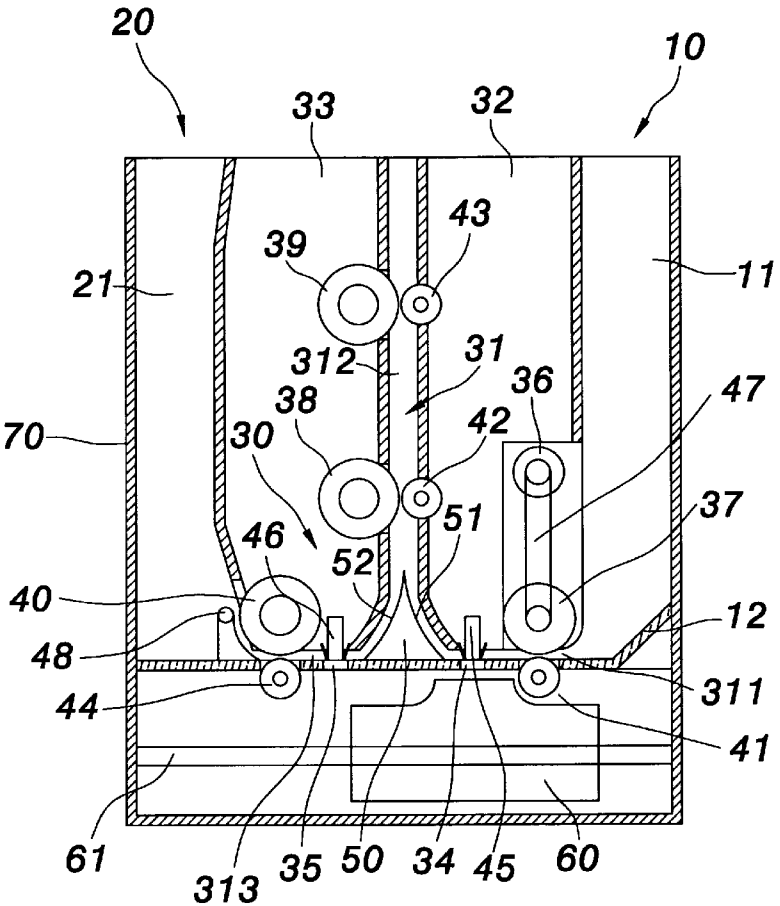
FIG. 4 shows a sectional view of the first preferred embodiment of the present invention.

With reference now to FIGS. 2, 3 and 4, the present invention is intended to provide a double-side automatic feeding apparatus for scanner or printer. The automatic feeding apparatus 70 of the present invention comprises a paper feeder 10, a paper outlet 20, a scanning region 30, a paper flipping unit 50 and an image sensor 60.

The paper feeder 10 and the paper outlet 20 are arranged at two opposite side of the feeding apparatus 70. The paper feeder 10 has a first space 11 for accommodating the document to be scanned and is an erect elongated space. The first space 11 has a guiding bevel 12 on bottom thereof to guide the document to the scanning region 30. The paper outlet 20 also has a second space 21 for accommodating the scanned document and is also an erect elongated space.

The scanning region 30 has a document traveling path 31 bridging the paper feeder 10 and the paper outlet 20. The document traveling path 31 is in W shape and provided between and below two racks 32 and 33. The document traveling path 31 is divided into a first segment 311, a second segment 312 and a third segment 313. The first segment 311 and the third segment 313 are placed below the racks 32 and 33, respectively and the second segment 312 is placed between the two racks 32 and 33. Each of the first segment 311 and the third segment 313 has one end connected to the paper feeder 10 and the paper outlet 20, respectively.

The scanning region 30 has a first transparent window 34 and a second transparent window 35, which are placed at the outer sides of the first segment 311 and the third segment 313, respectively. The first transparent window 34 and the second transparent window 35 are provided with a paper depressor 45 and a paper depressor 46, respectively on inner side thereof, which should be panel shape or wheel shape to clamp the document to be scanned and provide light-blocking functions.

The document traveling path 31 has a plurality of rollers 36, 37, 38, 39 and 40 for conveying the document from the paper feeder 10 to the paper outlet 20. In this invention, those rollers are referred as a paper-picking roller 36, a first roller 37, a second roller 38, a third roller 39 and a fourth roller 40. Moreover, a first idler 41, a second idler 42, a third idler 43, a fourth idler 44 and a fifth idler 48 are provided between the first roller 37, the second roller 38, the third roller 39 and the fourth roller 40. The rollers 36, 37, 38, 39 and 40 can be driven by a conventional transmission means (not shown) and the conventional transmission means will not be described in detail here.

The paper-picking roller 36 is arranged at a paper-picking arm 47, which is driven by a conventional transmission means (not shown) to swing in clockwise or counterclockwise direction, whereby the paper-picking arm 47 can drive the paper-picking roller 36 into the paper feeder 10 or out off the paper feeder 10.

The paper flipping unit 50 is arranged among the first segment 311, the second segment 312 and the third segment 313, and has a first guiding face 51 and a second guiding face 52. The first guiding face 51 and the second guiding face 52 are bevel face or curved face with guiding functions. The first guiding face 51 is provided between the first segment 311 and the second segment 312, and the second guiding face 52 is provided between the second segment 312 and the third segment 313. The paper flipping unit 50 can also be moved horizontally by a conventional transmission means (not shown) to flip the document along the document traveling path 31.

The image sensor 60 is provided at an outer side of the document traveling path 31 and movably mounted on a guiding rod 61. The image sensor 60 is selectively driven for placing at a first scan position at outer side of the first transparent window 34 or placing at a second scan position at outer side of the second transparent window 35, whereby the image sensor 60 can scan image on the first side or second side of the document. The image sensor 60 can be either a contact image sensor (CIS) or a charged coupled device (CCD) and can be replaced by a printing module in printer application.

Figure 5:
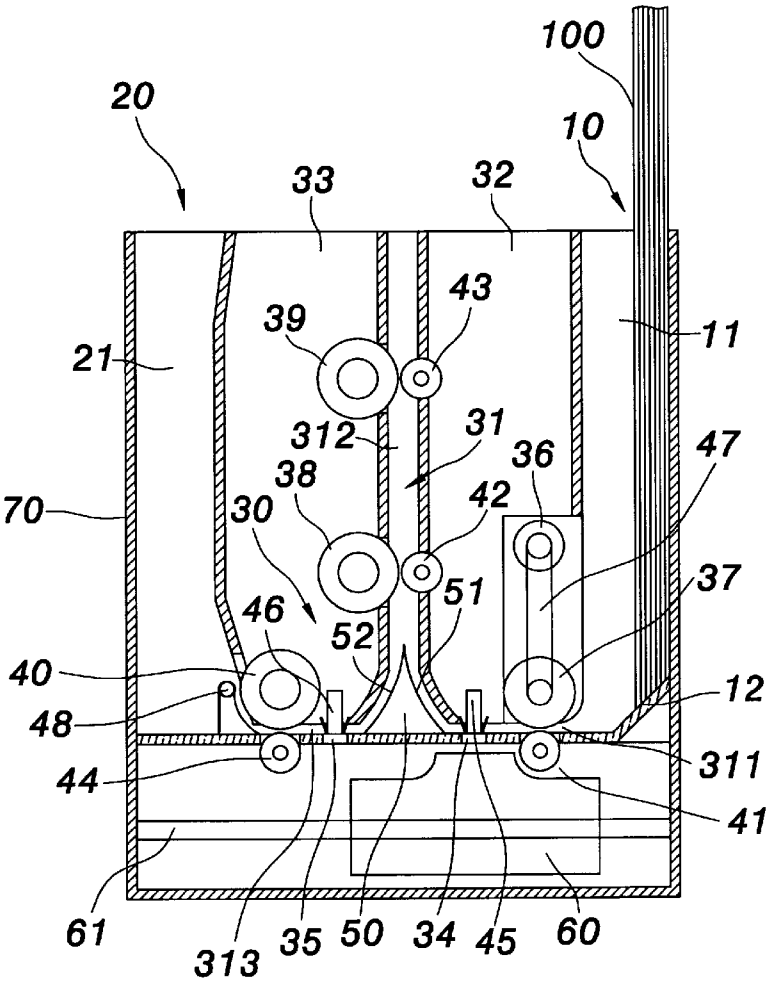
FIG. 5 shows the paper placement operation in the first preferred embodiment of the present invention.
Figure 7:
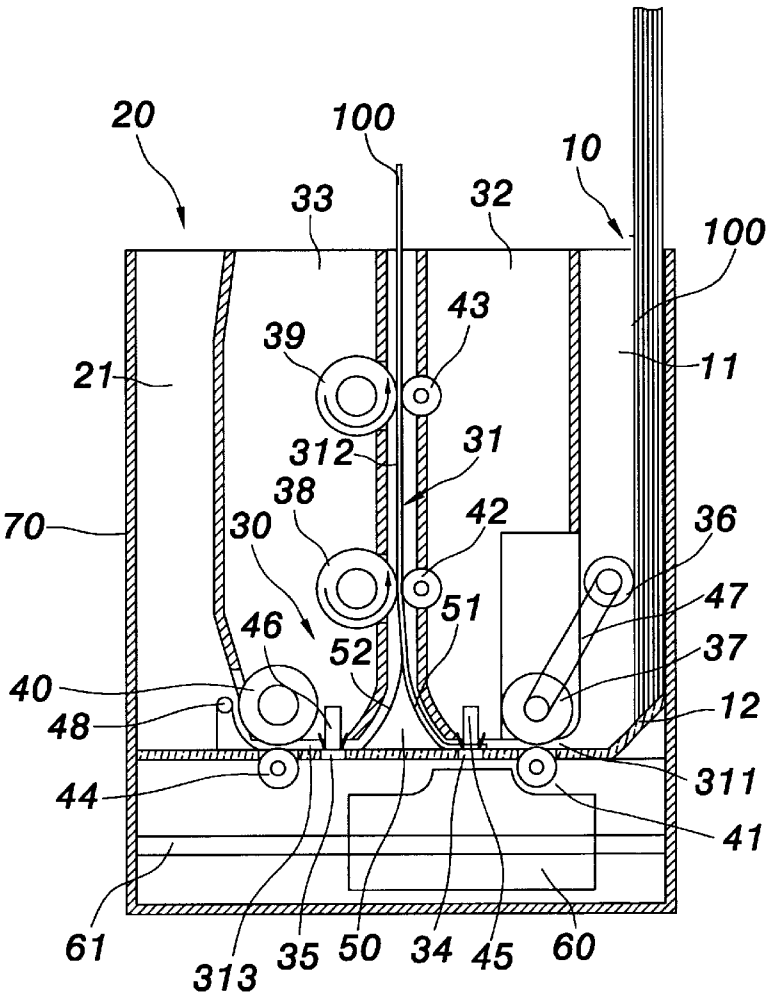
FIG. 7 shows the page flipping operation in the first preferred embodiment of the present invention.
Figure 6:
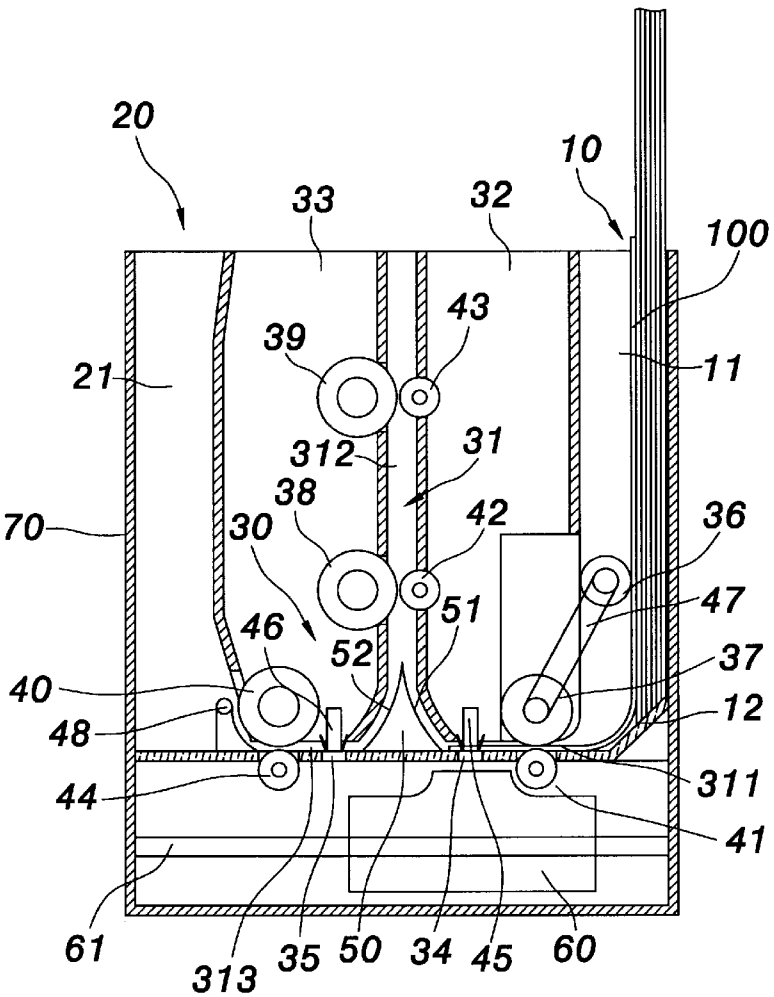
FIG. 6 shows the scanning operation for one side of document in the first preferred embodiment of the present invention.
Figure 8:
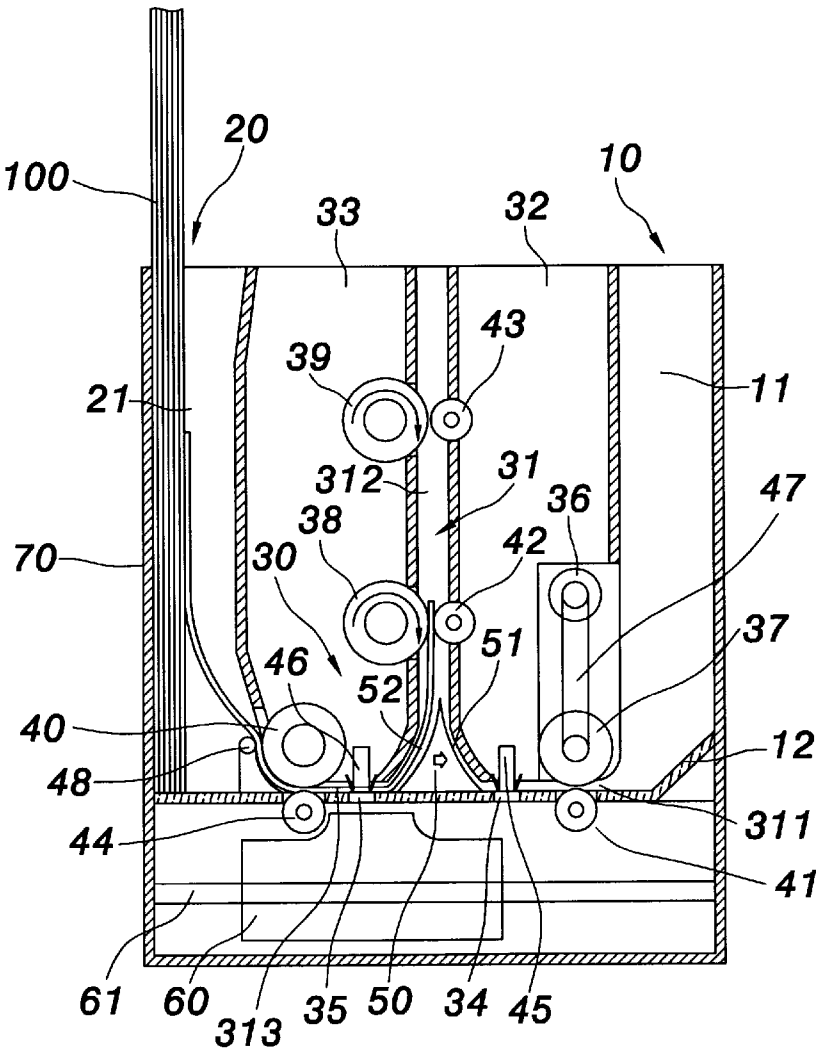
FIG. 8 shows the scanning operation for another side of document in the first preferred embodiment of the present invention.

With reference now to FIGS. 5, 6, 7, and 8, the document 100 to be scanned on double sides is placed in the first space 11 as shown in FIG. 5. The paper-picking arm 47 is triggered by a signal and moved into the paper feeder 10 and the paper-picking roller 36 is in contact with the document 100 as shown in FIG. 6. By the rotation of the paper-picking roller 36 and the first roller 37, the document 100 is fed to the first segment 311 in the document traveling path 31. At this time, the image sensor 60 is moved to the first scan position at outer side of the first transparent window 34. Afterward, the document 100 is guided by the first guiding face 51 of the paper flipping unit 50 and driven by the second roller 38 and the third roller 39, thus moving to the second segment 312 in the document traveling path 31, as shown in FIG. 7. When the document 100 is moved to a specific position in the second segment 312, the e paper flipping unit 50 is moved to such a position that the second guiding face 52 is aligned with the second segment 312. The document 100 is guided by the second guiding face 52 and driven by the second roller 38 and the third roller 39 in reversed direction, whereby the document 100 is moved to the third segment 313. At this time, the document 100 is subjected to page turning operation and the image sensor 60 is moved to the second scan position at outer side of the second transparent window 35, as shown in FIG. 8. Therefore, the image sensor 60 can scan the second side of the document 100. Afterward, the e document 100 is moved by the fourth roller 40 to the second space 21 of the paper outlet 20.

Figure 9:
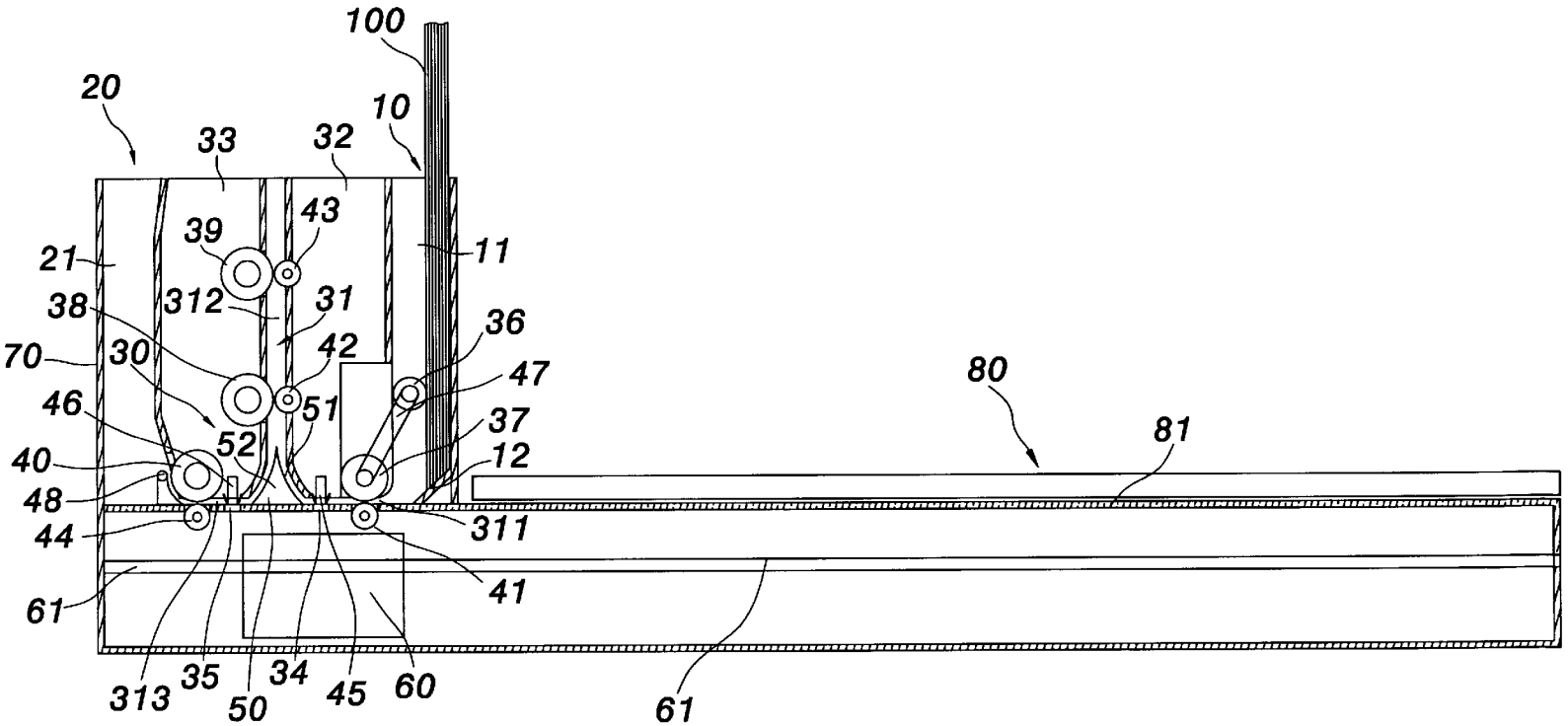
FIG. 9 shows a sectional view of the second preferred embodiment of the present invention.

With reference now to FIG. 9, the double-side automatic feeding apparatus of the present invention can also be used for flatbed scanner. As shown in this figure, the double-side automatic feeding apparatus 70 is arranged on one side of the flatbed scanner 80, which as a transparent flatbed 81 for placement of document to be scanned. The guiding rod 61 extends below the transparent flatbed 81 such that the image sensor 60 is movable below the transparent flatbed 81 and able to scan the document placed on the transparent flatbed 81.

The double-side automatic feeding apparatus of the present invention can facilitate the scanning operation for both sides of a document. More particularly, the paper feeder 10 and the paper outlet 20 are arranged at two opposite side of the feeding apparatus 70. The document fed in the paper feeder 10 can be output through the paper outlet 20 opposite to the paper feeder 10. Therefore, the cumbersome reverse movement is not required and the processing time is reduced.

Moreover, the paper feeder 10 and the paper outlet 20 are arranged at two opposite side of the feeding apparatus 70 and both of the first space 11 and the second space 21 are of erect elongated shape. The document can be automatically aligned by the weight per se and the operations of paper placement and removal can be simplified.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A double-side automatic feeding apparatus comprising:

a paper feeder;

a paper outlet opposite to the paper feeder;

a scanning region having a document traveling path bridging the paper feeder and the paper outlet, a plurality of rollers being arranged in the scanning region to convey a document to be scanned from the paper feeder to the paper outlet;

a paper flipping unit arranged in the document traveling path, the paper flipping unit being selectively switched in position to flip the document during passage thereof through the document traveling path; and, an image sensor disposed outside the document traveling path, the image sensor being selectively movable between a first scanning position and a second scanning position.

2. A double-side automatic feeding apparatus comprising:

a paper feeder;

a paper outlet opposite to the paper feeder;

a scanning region having a document traveling path bridging the paper feeder and the paper outlet, a plurality of rollers being arranged in the scanning region to convey a document to be scanned from the paper feeder to the paper outlet; and, a paper flipping unit arranged in the document traveling path, the paper flipping unit being selectively switched in position to flip the document during passage thereof through the document traveling path;

the paper feeder being an erect elongated space having a first space for accommodating a document to be scanned, the first space having a guiding bevel on a bottom thereof to guide the document to the scanning region.

3. The double-side automatic feeding apparatus as in claim 2, wherein the paper outlet has a second space for accommodating a scanned document and is an erect elongated space.

4. The double-side automatic feeding apparatus as in claim 1, wherein the document traveling path is divided into a first segment, a second segment and a third segment; the paper flipping unit has a first guiding face provided between the first segment and the second segment, and a second guiding face provided between the second segment and the third segment.

5. The double-side automatic feeding apparatus as in claim 1, wherein the scanning region has a first transparent window and a second transparent window, which are placed at an outer side of document traveling path.

6. The double-side automatic feeding apparatus as in claim 1, further comprising a plurality of idlers used with the rollers.

7. The double-side automatic feeding apparatus as in claim 1, wherein one of the rollers is a paper-picking roller and arranged at a paper-picking arm, which can move the paper-picking roller into or out of the paper feeder.

8. The double-side automatic feeding apparatus as in claim 1, wherein the automatic feeding apparatus is arranged on one side of a flatbed scanner.

9. A double-side automatic feeding apparatus comprising:

a paper feeder;

a paper outlet opposite to the paper feeder;

a scanning region having substantially a W-shaped document traveling path bridging the paper feeder and the paper outlet, a plurality of rollers being arranged in the scanning region to convey a document to be scanned from the paper feeder to the paper outlet;

a paper flipping unit intermediately disposed in the document traveling path, the paper flipping unit being selectively switched in position to flip the document during passage thereof through the document traveling path; and, an image sensor disposed outside the document traveling path in optical communication therewith.

* * * * *